US006203588B1

(12) United States Patent
Schröder et al.

(10) Patent No.: US 6,203,588 B1
(45) Date of Patent: Mar. 20, 2001

(54) METHOD OF PRODUCING A GRINDING ROLL

(75) Inventors: Heinz Schröder; Helmut Lücke, both of Beckum; Ludger Rübbelke, Delbrück, all of (DE)

(73) Assignees: Krupp Polysius AG; Schwäbische Hüttenwerke GmbH, both of (DE)

( * ) Notice: Subject to any disclaimer, the term of this patent is extended or adjusted under 35 U.S.C. 154(b) by 0 days.

(21) Appl. No.: 09/189,667

(22) Filed: Nov. 11, 1998

(30) Foreign Application Priority Data

Nov. 12, 1997 (DE) ..... 197 50 144

(51) Int. Cl.[7] ..... B21B 27/02; B02C 4/30; B02C 4/08; C22C 38/18; B24D 17/00

(52) U.S. Cl. ..... 51/293; 51/307; 241/227; 241/235; 241/242; 241/294; 492/30; 492/60

(58) Field of Search ..... 51/307, 293, 295; 241/227, 228, 229, 235, 242, 294, 260; 492/30, 38, 60

(56) References Cited

U.S. PATENT DOCUMENTS 4,396,442 * 8/1983 Nakamura et al. ..... 148/138
4,448,610 * 5/1984 Bellocci ..... 148/3
4,484,953 * 11/1984 Kovacs et al. ..... 148/3
4,541,878 * 9/1985 Muhlberger et al. ..... 148/139
4,800,949 * 1/1989 Bak et al. ..... 164/460
4,880,477 * 11/1989 Hayes et al. ..... 148/141
5,312,056 * 5/1994 Kastingschafer et al. ..... 241/235

FOREIGN PATENT DOCUMENTS 0 563 564B1 6/1997 (DE) .

OTHER PUBLICATIONS

Dipl.–ing. Walter H. Duda, Cement–Data–Book, vol. 1, International Process Engineering in the Cement Industry, 3rd, revised and enlarged new edition, Wiesbaden und Berlin—1985, No Month.

Derwent Acc–No. 1978–27284A, week No. 197815 abstract based on De 2744458A, Apr. 1978.*

* cited by examiner

*Primary Examiner*—Michael Marcheschi
(74) *Attorney, Agent, or Firm*—Reising, Ethington, Barnes, Kisselle, Learman & McCulloch, P.C.

(57) ABSTRACT

The invention relates to a method of producing a grinding roll in which a roll tire made from a highly wear-resistant bainitic cast material is applied to the basic roll body. In order to create a roll tire with particularly high reliability against fractures and with relatively high wear resistance and compression strength, the roll tire is produced from a ductile bainitic spheroidal graphite cast material having a breaking elongation of approximately 0.1 to 2.5% and a compression strength of approximately 1,000 to 1,800 Mpa.

12 Claims, No Drawings

METHOD OF PRODUCING A GRINDING ROLL

The invention relates to a grinding roll for the comminution of brittle feed materials in a material bed roll mill.

BACKGROUND OF THE INVENTION

It is already generally known that relatively brittle mill feed materials, such as for example cement raw materials, cement clinker, ore material, coal and the like, can be comminuted particularly economically or with a saving of energy in a so-called material bed roll mill in which two grinding rolls which can be driven in rotation in opposite directions are pressed against one another with a relatively high pressure (cf. for example Walter Duda, Cement-Data-Book, Vol. 1, 3rd edition, 1985, pages 255 to 261).

Since the outer circumferential roll surfaces are subjected to very high stresses both with regard to abrasion (wear) and also with regard to pressures, especially in the case of the aforementioned brittle and abrasive mill feed materials, the tire of each grinding roll is produced from particularly wear-resistant material. These roll materials include chilled cast iron as well as alloyed hard materials which are applied by build-up welding onto the roll base material. Nevertheless when comminution occurs in a material bed roll mill the high pressures acting on the roll surfaces or roll tires have the effect that, after a period of time, the roll material, particularly the build-up welded roll tires usually used nowadays, becomes fatigued particularly in the region near the surface, in addition to the sometimes considerable wear. This material fatigue limits the service life of these grinding rolls so that the roll tires can no longer be reused.

In EP-B-0 563 564 a material bed roll mill is proposed in which grinding rolls have a tire made from a wear-resistant chilled cast iron, which may for example be inter alia a highly wear-resistant bainitic cast material. The special feature of these known grinding rolls is that profilings in the form of weld beads made from wear-resistant build-up welding material are applied to the surface of the chilled cast iron tire of each grinding roll. It has in fact been shown that, by constructing the grinding rolls from chilled cast iron with build-up welds, a markedly higher compression strength and thus a longer service life with regard to wear can be achieved by comparison with the build-up welded grinding rolls mentioned above. In providing these known grinding rolls with a tire made from chilled cast iron, however, the chilled cast iron or chilled cast material has a relatively brittle behaviour. In the case of relatively pulsating or striking comminution work or stress, such as is frequently the case with very brittle mill feed materials in large lumps, this can lead to spontaneous fracture of the chilled cast material. Moreover, unwanted fractures can even occur during the production of the grinding rolls; that can occur due to the contraction strains occurring when the tire is being shrink-fitted onto the basic roll body.

The object of the invention, therefore, is to improve the known method referred to above in such a way that, while maintaining a relatively high wear resistance and compression strength, a particularly high operational reliability of the roll tire (and thus of the entire grinding roll) in relation to fractures can be achieved.

SUMMARY OF THE INVENTION

A significant characteristic of the present invention is the fact that the roll tire is produced from a ductile bainitic spheroidal graphite cast material having a breaking elongation of approximately 0.1 to 2.5% and a compression strength of approximately 1,000 to 1,800 MPa, a preferred maximum value for the aforementioned breaking elongation being approximately 2.0%. By comparison with the known grinding rolls (from EP-B-0 563 564) which are described above and in which the tire is produced from relatively brittle chilled cast iron, the production of grinding rolls according to the invention results in a tire material which, apart from its high compression strength and wear resistance, is distinguished by a relatively high impact resistance, so that this material and thus the roll tire produced therefrom ensures a particularly high reliability against fractures of the tire. In the extensive tests on which the invention is based it was possible to demonstrate this high reliability against fractures as well as a relatively high compression strength of the material. When this roll tire material was used no material fatigue occurred even in the case of relatively high and irregular loads during the comminution of brittle mill feed materials in a material bed roll mill.

According to a preferred embodiment of the invention the cast material and thus the roll tire has a breaking elongation of approximately 0.5 to 2.5%, and preferably of approximately 0.5 to 2.0%, and a compression strength of approximately 1,200 to 1,600 MPa.

Furthermore, it is regarded as particularly advantageous if the roll tire has a Rockwell hardness of approximately 42 to 55, preferably approximately 45 to 50.

In order always to be able to ensure reliable drawing in of brittle feed material into the grinding gap between the two grinding rolls of a material bed roll mill, a surface profiling which is known per se (from EP-B-O 563,564, for example) is applied to the outer circumferential surface of the grinding rolls. Although this surface profiling may be produced or constructed at the time of casting the roll tire, it is generally preferred to construct this surface profiling by build-up welding of hard material onto the outer circumferential surface of the roll tire.

According to a variant which is advantageous in many ways, the possibility also exists of first of all applying a plurality of complete additional layers of hard material by build-up welding onto the outer circumferential surface of the roll tire and forming the surface profilings of hard material onto the outermost additional layer, likewise by hard build-up welding.

In the aforementioned tests it was possible to establish and to confirm that the cast material used according to the invention for the roll tire tolerates the aforementioned build-up welding extremely well. Since with this cast material—as mentioned above—no material fatigue occurs, there is a further advantage that worn build-up welds can be replaced as required and thus the wear surface of the roll tire can be regenerated correspondingly easily and frequently. Because of the provision of build-up welds on the cast material according to the invention an extremely wear-resistant roll tire is produced which has a particularly long service life by comparison with the known constructions. This is also assisted by the fact that—as the tests have likewise shown—the hard material applied by build-up welding is even harder than in the aforementioned known constructions. Even if cracks should occur during cooling of the hard build-up welding material, these are only relatively short cracks which do not seriously detract from the wear resistance and compression strength or the service life of the roll tire.

DETAILED DESCRIPTION

Examples are given below for typical compositions for the production according to the invention of the tire of a grinding mill.

A tire or roll body produced according to the invention is formed from a ductile bainitic spheroidal graphite cast material containing the following materials, by weight: 3.0–3.5% carbon, 1.5–2.0% silicon, 0.3–0.4% manganese, 0.05% phosphorus, 1.5–4.0% nickel, 0.7–1.0% molybdenum and 0.04–0.07% magnesium. Preferably the proportion of silicon is approximately 1.8–2.0%.

A highly wear-resistant chromium/carbon alloy in which special carbides form, apart from chromium carbides, is preferably used as hard build-up welding material. As an alternative to this the hard material may also be formed by highly wear-resistant tungsten carbide build-up welds.

According to a typical example, the hard build-up welding material is formed by a hard alloy containing (by weight) approximately 5.0% carbon, approximately 2.0% manganese, approximately 1.5% silicon, approximately 22.0% chromium, approximately 7.2% niobium and approximately 0.5% vanadium.

In the production according to the invention of the grinding roll, and in particular of the roll tire, the material characteristics of the ductile bainitic spheroidal graphite cast material can be set in the desired of necessary manner by controlled cooling and/or heat treatment.

It should be pointed out that the grinding roll produced according to the invention may otherwise generally be constructed in terms of design or structure or shape in the same way as is generally known in the case of material bed roll mills and also essentially as described in the aforementioned EP-B-0 563 564. This means therefore that the grinding roll generally consists of two parts, namely, the basic roll body (partly also denoted as roll shaft) and the roll tire which is firmly fixed thereto. In this case the basic roll body can be produced in the usual manner as a forged component, onto which the roll tire is firmly and reliably fixed for example by a releasable shrink fit.

Among the significant advantages of the roll tire produced from ductile bainitic spheroidal graphite case material are:

the tire according to the invention has a high compression strength similar to known rolls made from chilled cast materials, but in this case material fatigue does not occur, resulting in a particularly long service life;

the high compression strength of the ductile bainitic spheroidal graphite cast material allows higher grinding pressures than in build-up welded grinding rolls;

apart from the excellent compression strength the roll tire produced from the ductile bainitic spheroidal graphite cast material has particularly good impact resistance characteristics, as a result of which it has particularly high reliability against brittle failure or brittle fractures;

by sensible variations in the chemical analysis of the cast material as well as by a controlled cooling and/or heat treatment of the roll tire after casting, the material characteristics can be optimally adapted to the stresses during comminution in a material bed roll mill.

What is claimed is:

1. A grinding roll adapted for use in a material bed roll mill for the comminution of brittle material, said roll having a roll body fitted with a wear resistant peripheral tire formed from ductile bainitic spheroidal graphite material and having a breaking elongation of approximately 0.1 to 2.5% and a compression strength of approximately 1,000 to 1,800 MPa, said tire having on its peripheral surface profiled beads of wear resistant material.

2. The roll according to claim 1 wherein the breaking elongation is at least 0.5% and the compression strength is between approximately 1,200 and 1,600 MPa.

3. The roll according to claim 1 wherein said tire has a hardness of approximately 42–55 HRc.

4. The roll according to claim 1 wherein said profiled beads of wear resistant material are deposited on said surface.

5. The roll according to claim 1 wherein said tire has fixed on its peripheral surface a plurality of layers of wear resistant material.

6. The roll according to claim 1 wherein the tire has an array of profiled beads on its peripheral surface comprising a wear resistant alloy of chromium and carbon which forms carbides apart from chromium carbides.

7. The roll according to claim 1 wherein the tire has an array of profiled beads on its peripheral surface comprising an alloy composed of approximately 5.0% carbon, approximately 3.0% manganese, approximately 1.5% silicon, approximately 22.0% chromium, approximately 7.2% niobium, and approximately 0.5% vanadium, said percentages being by weight.

8. The roll according to claim 1 wherein the tire has an array of profiled beads on its peripheral surface comprising tungsten carbide.

9. The roll according to claim 1 wherein said ductile bainitic spheroidal graphite material comprises an alloy of 3.0–3.5% carbon, 1.5–2.0% silicon, 0.3–0.4% manganese, 0.05% phosphorus, 1.5–4.0% nickel, 0.7–1.0% molybdenum, and 0.04–0.07% magnesium.

10. The roll according to claim 1 wherein the material forming said tire has its hardness characteristics set by temperature control.

11. A grinding roll adapted for use in a material bed roll mill for the comminution of brittle material, said roll having a roll body fitted with a wear resistant peripheral tire formed from ductile bainitic spheroidal graphite material and having a breaking elongation of approximately 0.1 to 2.5%, said tire having on its peripheral surface an array of profiled beads of wear resistant build-up welding material comprising tungsten carbide.

12. A grinding roll adapted for use in a material bed roll mill for the comminution of brittle material, said roll having a roll body fitted with a peripheral tire having a plurality of layers of wear resistant material thereon, said tire being formed from a ductile spheroidal graphite material, and having a breaking elongation of approximately 0.1 to 2.5% and a compression strength of approximately 1,000 to 1,800 MPa, one of said layers being outermost and said outermost layer having thereon an array of profiled beads of hard build-up welding material comprising tungsten carbide.

* * * * *

UNITED STATES PATENT AND TRADEMARK OFFICE

CERTIFICATE OF CORRECTION

PATENT NO. : 6,203,588 B1
DATED : March 20, 2001
INVENTOR(S) : Heinz Schroder et al.

It is certified that error appears in the above-identified patent and that said Letters Patent is hereby corrected as shown below:

Column 4,
Line 52, after ductile insert -- bainitic --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*